US005251565A

United States Patent [19]

Phillips

[11] Patent Number: 5,251,565

[45] Date of Patent: Oct. 12, 1993

[54] PROCESS AND APPARATUS FOR REMOVAL OF CARBONACEOUS MATERIALS FROM PARTICLES CONTAINING SUCH MATERIALS

[75] Inventor: Michael C. Phillips, Amsterdam, Netherlands

[73] Assignee: Shell Oil Company, Houston, Tex.

[21] Appl. No.: 855,822

[22] Filed: Mar. 23, 1992

Related U.S. Application Data

[63] Continuation-in-part of Ser. No. 794,106, Nov. 18, 1991, abandoned.

[30] Foreign Application Priority Data

Dec. 13, 1990 [GB] United Kingdom ..... 9027038.0

[51] Int. Cl.[5] ..... F23G 5/00

[52] U.S. Cl. ..... 110/346; 110/236; 110/245; 208/164; 422/144

[58] Field of Search ..... 110/346, 236, 245; 208/113, 164; 422/144

[56] References Cited

U.S. PATENT DOCUMENTS

| | | | |
|---|---|---|---|
| 3,208,831 | 9/1965 | Belden | 23/288 |
| 3,412,013 | 11/1968 | Bowles | 502/43 |
| 3,563,911 | 2/1971 | Pfeiffer et al. | 252/417 |
| 3,902,990 | 9/1975 | Luckenbach | 208/164 |
| 4,260,475 | 4/1981 | Scott | 208/113 |
| 4,332,674 | 6/1982 | Dean et al. | 208/120 |
| 4,336,160 | 6/1982 | Dean et al. | 252/417 |
| 4,444,651 | 4/1984 | Myers et al. | 208/120 |
| 4,750,436 | 6/1988 | Maury et al. | 110/346 |
| 4,821,654 | 4/1989 | Becker et al. | 110/236 |
| 4,822,761 | 4/1989 | Walters et al. | 502/38 |
| 4,849,091 | 7/1989 | Cabrera et al. | 208/113 |
| 4,917,790 | 4/1990 | Owen | 208/113 |
| 5,011,592 | 4/1991 | Owen et al. | 208/113 |

FOREIGN PATENT DOCUMENTS 2210654 6/1974 France .

*Primary Examiner*—Edward G. Favors

[57] ABSTRACT

Process and apparatus for the removal of carbonaceous materials from particles containing such materials, comprising introducing said particles into the lower part of a first, riser-type reactor, into which lower part an oxygen-containing gas is introduced, the reactor being operated under entrainment conditions with a relatively high density phase in the lower part and with a relatively low density phase in the upper part at a temperature suitable to burn off carbonaceous materials at such a rate that the flue gas at the top of the reactor does not contain any substantial amount of oxygen, separating solids and gas at the top of the reactor, introducing the separated particles into the upper part of a second, fluidized bed-type reactor while introducing an oxygen-containing gas into the lower part of the second reactor, the reactor being operated under fluidized bed conditions at a temperature suitable to burn off carbonaceous materials, the amount of oxygen-containing gas being established in such a way that the flue gas at the top of the reactor is substantially free of oxygen, removing processed particles from the lower part of the reactor, and recirculating a part of the processed particles to the lower part of the riser-type reactor.

13 Claims, 1 Drawing Sheet

PROCESS AND APPARATUS FOR REMOVAL OF CARBONACEOUS MATERIALS FROM PARTICLES CONTAINING SUCH MATERIALS

This is a Continuation-in-Part of application Ser. No. 794,106, filed Nov. 18, 1991, now abandoned.

BACKGROUND OF THE INVENTION

1. Field of Invention

The present invention relates to a process and an apparatus for the removal of carbonaceous materials from particles containing such materials.

2. Description of the Prior Art

Fluid catalytic cracking (FCC) processes are used to convert relatively heavy hydrocarbon products obtained from crude oil processing into lighter hydrocarbon products. The catalyst particles used in these processes very quickly become contaminated with carbonaceous materials. These hydrocarbonaceous materials have to be removed in a regeneration process in order to permit reuse of the catalyst particles. In order to regenerate the catalyst, it is contacted with an oxygen-containing gas in a fluidized bed at a temperature suitable to burn off the carbonaceous materials, thus restoring the activity of the catalyst.

Suitable FCC feeds are gas-oils boiling in the range from about 250° C. to about 590° C., especially from about 370° C. to about 540° C. However, at the present moment, there is a tendency to use heavier feeds, such as atmospheric and vacuum residual oils, often mixed with gas-oils. Since these residual feeds usually contain considerable amounts of asphaltenes, which have a high tendency to form coke during the cracking operation, a larger amount of coke will be deposited on the catalyst. This is especially true when only residual feeds are used without mixing them with lighter gas-oil fractions. In regenerating these heavily coked, spent catalyst particles, it may be difficult to burn off enough coke to provide a suitable low concentration of carbon on the regenerated catalyst. To overcome these difficulties, regenerators are suggested in which the coke is burned to carbon monoxide, thus limiting the formation of heat in the regenerator. The carbon monoxide may be used as fuel gas for the production of electricity or steam. Alternatively, a carbon monoxide boiler may be included after the regenerator to complete the combustion of carbon monoxide to carbon dioxide.

A process and an apparatus for the regeneration of spent FCC catalyst particles by burning off the carbon under the formation of carbon monoxide are described in U.S. Pat. No. 4,260,475, issued Apr. 7, 1981. The first stage of this regeneration process is performed in a riser-type regenerator employing an entrained bed of upwardly moving catalyst particles in concurrent flow with regeneration gas. The second stage of the regeneration is performed in a staged fluidized bed of catalyst particles in a net downward movement countercurrent to the regeneration gas. The process of U.S. Pat. No. 4,260,475 has a number of clear advantages over other known regeneration processes, as has been described in its specification.

One disadvantage of the process described in U.S. Pat. No. 4,260,475 is that the riser regenerator has to be of an extremely large height in order to obtain a reasonable removal of carbonaceous materials in the first stage. This is due to the fact that the temperature of the spent catalyst particles is initially too low for a rapid combustion.

An optimum performance of the catalytic cracking process is obtained when the starting reaction mixture of hydrocarbons and catalyst particles in the lower end of the riser reactor has a temperature of 520° C. to 560° C. During the cracking process in the riser reactor, the temperature decreases 20° C. to 30° C. due to the endothermic character of the reaction, thus resulting in a temperature of the spent catalyst particles of 490° C. to 540° C. During the usual stripping of the catalyst, the temperature will fall another 5° C. Thus, the spent catalyst particles introduced into the riser regenerator usually will have a temperature of between 485° C. and 535° C. This temperature is too low for an efficient combustion of the carbonaceous materials deposited on the catalyst particles during the cracking process. Efficient combustion takes place at a temperature of at least 650° C. Therefore, the slowly oxidizing mixture of spent catalyst and oxygen has to be transported over a long distance in the riser regeneration reactor before a sufficiently high temperature is obtained—due to the exothermal oxidation—at which combustion can take place at a reasonable velocity. As a result, riser regeneration reactors of an extremely large height are necessary, leading to an increase in construction costs and a large catalyst inventory, thus resulting in high material, maintenance and operating costs of the unit.

U.S. Pat. No. 4,444,651, issued Apr. 24, 1984, discloses a process for carbo-metallic oil conversion which includes contacting a feed with cracking catalyst containing greater than 600 ppm of nickel equivalents of heavy metal and regenerating the metal-bearing, coked catalyst by burning the coke in a two-stage regeneration zone with oxygen and producing a product gas containing $CO_2$.

U.S. Pat. No. 4,336,160, issued Jun. 22, 1982, discloses a side-by-side hydrocarbon conversion, two-stage stacked regeneration system whereby the temperature is restricted within the first stage, thereby giving incomplete removal of carbon, and increased in the second stage to allow for the further removal of carbon and the production of a $CO_2$ rich gas.

U.S. Pat. No. 4,332,674, issued Jun. 1, 1982, discloses a two-stage hydrocarbon conversion-catalyst regeneration process and apparatus which operates with two separate stacked high and low temperature stages and contains a special arrangement to allow for intimate vaporization contact between the residual oil feed and the high temperature catalyst charged to the riser.

U.S. Pat. No. 3,902,990, issued Sept. 2, 1975, discloses a process for regeneration of spent catalyst by introducing the spent catalyst above a dense fluidized bed of catalyst first and then contacting the catalyst with a hot flue gas from the dense fluidized bed followed by an oxygen-containing gas and further contacting it with an additional oxygen-containing gas in the second stage of the process.

U.S. Pat. No. 3,208,831, issued Sept. 28, 1965, discloses an apparatus for the contacting of fluids with fluidized subdivided solid catalyst particles in a reaction chamber followed by a regeneration chamber and then storing the regenerated catalyst.

SUMMARY OF THE INVENTION

It is the object of the present invention to provide a process and apparatus for the removal of carbonaceous materials from particles containing such materials by introducing the particles into the lower part of a first, riser-type reactor along with an oxygen-containing gas. A relatively high density phase is maintained in the lower part of the reactor while a relatively low density phase is maintained in the upper part. A temperature which is suitable to burn off carbonaceous materials at such a rate that the flue gas at the top of the reactor does not contain any substantial amount of oxygen is used. The solids and gas are separated at the top of the reactor with the separated particles being introduced into the upper part of a second, fluidized bed-type reactor while introducing an oxygen-containing gas into the lower part of the second reactor. The second reactor is operated under fluidized bed conditions at a temperature suitable to burn off carbonaceous materials with the amount of oxygen-containing gas being established in such a way that the flue gas at the top of the reactor is substantially free of oxygen. The processed particles are then removed from the lower part of the second reactor and a part of them are recirculated to the lower part of the riser-type reactor.

DESCRIPTION OF THE PREFERRED EMBODIMENT

Figure 1:
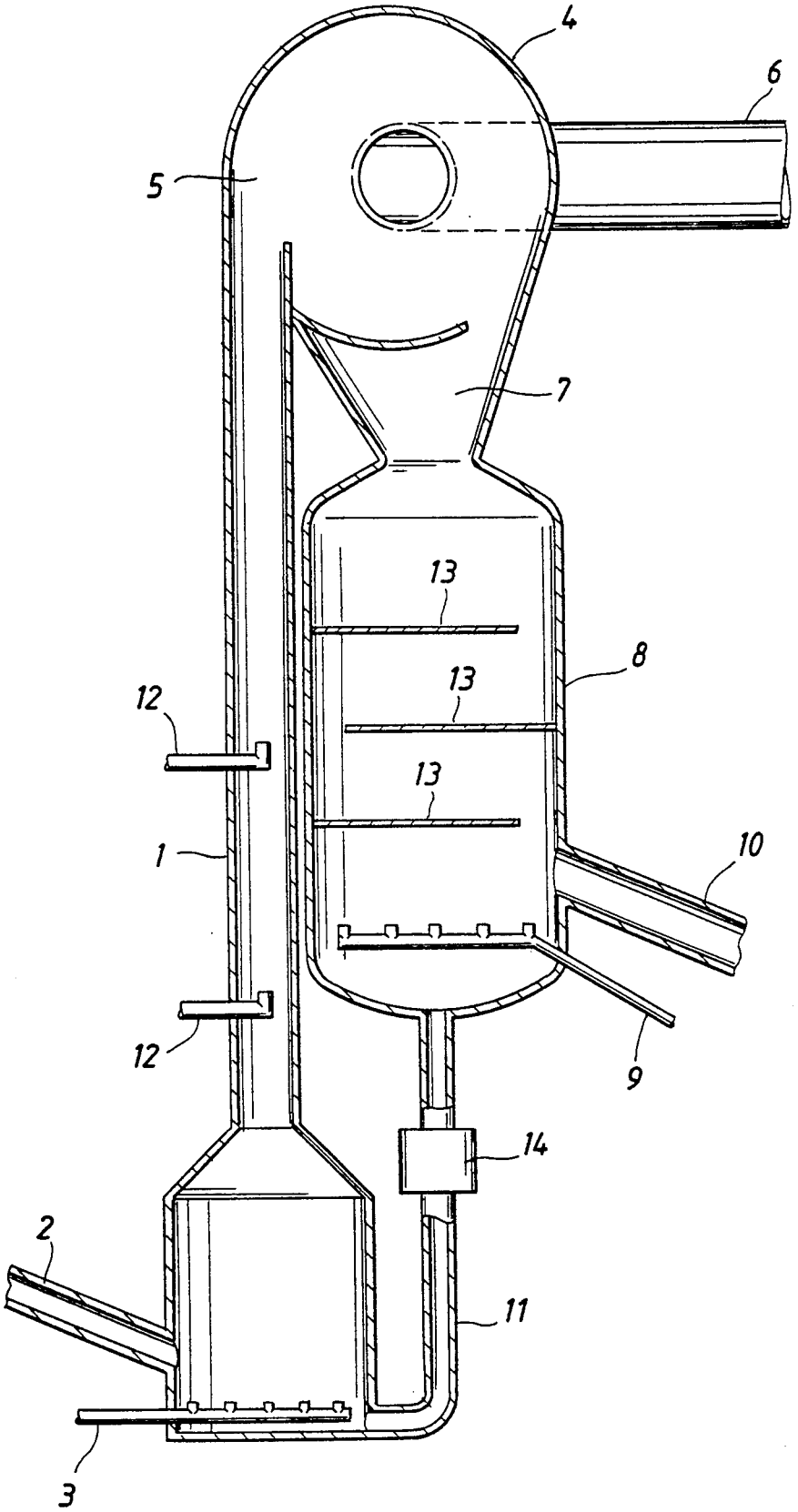
FIG. 1 represents an illustration of the apparatus suitable for carrying out the preferred embodiment of the claimed process of the invention using an elongated reactor and a fluidizing bed reactor which are connected, both with various inlets and outlets as well as means of separating gases and solids.

In the preferred embodiment of the current invention, the disadvantages of U.S. Pat. No. 4,260,475, the removal of carbonaceous materials from particles containing such material, are overcome by introducing said particles into the lower part of a first, riser-type reactor along with a substoichiometric, stoichiometric, or excess amount of an oxygen-containing gas wherein the reactor is being operated under entrainment conditions with a relatively high density phase in the lower part and a relatively low density phase in the upper part. The temperature employed is one suitable to burn off carbonaceous materials at such a rate that the flue gas at the top of the reactor does not contain any substantial amount of oxygen. The reacted particles and gas are separated at the top of the reactor, and then the reacted particles are introduced into the upper part of a second, fluidized bed-type reactor while an oxygen-containing gas is introduced into the lower part of the second reactor. This second reactor is operated under fluidized bed conditions at a temperature suitable to burn off carbonaceous materials. The amount of oxygen-containing gas used is such that the flue gas at the top of the reactor is substantially free of oxygen. Processed particles are removed from the lower part of the reactor with part of these particles being recirculated to the lower part of the riser-type In the current process, by circulating the regenerated catalyst particles from the second reactor to the first reactor an increase of the temperature of the particles in the first reactor takes place. As a result thereof, and due to the fact that the lower part of the first reactor is operated in a relatively dense phase thereby making a longer residence time as compared with a relatively low density phase, a considerable part of the carbonaceous materials is already burned off in the lower part of the reactor. Thus, the height of the riser-type reactor may be brought back to a more practical height.

Whenever the process is operated by supplying substoichiometric amounts of oxygen-containing gas to the first or both reactors, recirculation of regenerated catalyst particles from the second reactor to the first reactor is particularly beneficial as compensation for the limited heat formation in the first reactor.

It is observed that due to the fact that the operation of the second reactor, at least within certain boundaries, is independent from the operation of the first reactor, the system has a great flexibility, and thus the amount of circulating particles may be varied over a wide range. This is especially true when the particle inventory of the second regenerator is relatively large as compared with the first reactor. The ratio of the amount of particles which are removed from the second reactor and the amount of particles which are introduced again into the first reactor may vary between about 0.1 and about 10, and is preferably between about 0.2 and about 5, even more preferably between about 0.3 and about 1. The recirculated particles have to be introduced into the relatively high density phase in the first reactor. Recirculated particles may be removed via one or more outlets in the second regenerator at different heights.

The process of the present invention is especially suitable for the regeneration of spent FCC catalyst particles, although it may also be used for other processes, such as the combustion of retorted oil shale particles. The amount of carbon on the FCC catalyst particles is suitably from about 0.5% wt to about 4% wt, preferably from about 3% wt to about 1.5% wt. These particles are introduced into the relatively high density phase of the first reactor.

The process of the present invention is suitably carried out at a temperature in the first reactor from about 525° C. to about 725° C., especially from about 550° C. to about 650° C., and at a temperature in the second reactor from about 625° C. to about 950° C., especially from about 700° C. to about 800° C. The substoichiometric amount of oxygen introduced in the first reactor may be in the amount from about 20% to about 70% of the amount necessary to burn all the carbonaceous materials, and is preferably from about 40% to about 60%, even more preferably about 50%. The pressure in both reactors is suitably from about 1 and about 10 bar, preferably from about 1.5 bar to about 4 bar. The pressure drop over the first reactor is suitably from about 0.1 bar to about 2 bar, preferably from about 0.3 bar to about 1 bar. The pressure drop over the second reactor is suitably from about 1 bar to about 5 bar, preferably from about 1.5 bar to about 4 bar.

The second reactor to be used in the process according to the present invention is preferably a staged fluidized bed.

As indicated above, the process of the present invention is especially suitable for the regeneration of spent FCC catalyst particles. The feed for the FCC process is suitably a hydrocarbon fraction boiling from about 250° C. to about 590° C., especially from about 370° C. to about 540° C. Preferred feeds are atmospheric and vacuum residual fractions and so-called synthetic feeds, such as coal oils, bitumen, shale oils and high boiling fractions thereof. Usually the boiling range is from about 250° C. to about 600° C., or higher, and preferably a substantial amount boils above about 450° C. The conversion conditions include a temperature in the range from about 425° C. to about 625° C., preferably from about 510° C. to about 610° C. Cracking conditions preferably also include a pressure in the range from about atmospheric to about 4 atmospheres or more, particularly preferable from about 2 atmospheres to about 3 atmospheres.

In cracking, using a fluidized bed of particulates, a catalyst: hydrocarbon weight ratio of about 2 to about 50, preferably from about 3 to about 10 is usually suitable. A hydrocarbon weight hourly space velocity in the cracking operation of from about 5 to about 50 per hour is preferably used.

The cracking zone employed may be of conventional design and may use dilute-phase fluidized solids contact, riser-type entrained solids contact, dense-bed fluidized solids contact, countercurrent contact, a moving, packed bed of solids or a combination thereof, between the feed hydrocarbons and the catalyst particles. Catalyst fluidization, entrainment, and such may be assisted by gases such as steam or nitrogen. Conventional spent solids stripping means for removing volatiles from the spent solids may also suitably be employed.

The particulate solids to be used in the cracking process may optionally be catalytically active or may simply act as a heat carrier and sorbent for the hydrocarbons. Essentially, the particulate solids employed must be suitably attrition resistant and refractory to the high temperatures and to steaming which are characteristic of the process, so that the particles may be circulated for a practical period of tune in a fluidized system. Conventional particulate cracking catalysts and heat transfer solids can be used in the present process. Suitable cracking catalysts may include a zeolitic crystalline aluminosilicate component.

Particulate solids other than active, acidic cracking catalyst may alternatively or additionally be circulated in the cracking system. For example, alumina particles may be included in the particulate solids inventory to help control sulphur oxides and/or particles containing a highly active combustion promoting metal, such as a Group VIII noble metal, may be mixed with the catalyst or heat carrier particles. Likewise, particles having a heat-carrying capacity but low intrinsic acidic cracking activity may be circulated either alone or mixed with more active and acidic cracking catalyst to provide heat for either acidic or essentially thermal cracking of the hydrocarbons.

According to the invention, coke containing particles which result from cracking of hydrocarbons are regenerated in two steps: (1) an entrained bed step, in which particles and regeneration gas move in concurrent, upward flow; and (2) a fluidized bed step, in which particulates and regeneration gas move in generally countercurrent flow.

The first regeneration zone, in which particulates are partially regenerated in entrained flow in upwardly moving gases, may suitably be defined by any vessel, conduit, reactor or the like capable of containing the upwardly moving gases and solids at the temperatures and pressures employed in the first regeneration stage. Riser-type vessels or transfer line vessels of the type used conventionally in carrying out riser-cracking in fluidized catalytic cracking systems are suitable for use as the first regeneration zone in the present process. The vessels or conduits used to provide the riser-type regeneration zone can be sized in length and cross-sectional area to provide the desired gas and solids flow rates and residence times in order to create the relatively high density phase in the lower part of the zone, and a relatively low density phase in the upper part of the zone. Suitable measures to create the differences in density are introduction of sufficient amounts of gas at a certain height, or decreasing the cross-sectional area, thus increasing the gas velocity. In case of a smaller cross-sectional area, the cross-sectional area of the relatively high density phase zone is suitably from about 4 to about 100 times as large as the cross-sectional area of the relatively low density zone, preferably from about 5 to about 50, more preferably from about 9 to about 25.

The riser-regenerator is preferably equipped with means for introducing molecular oxygen into the entraining gas stream at a plurality of vertically spaced levels in the first regeneration zone.

The second regeneration zone, in which fluidized particulates move generally downward, countercurrent to upward moving gases, may likewise be defined by any vessel, conduit, reactor or the like capable of containing the fluidized particles in flowing gases at the temperatures and pressures used in the second, fluidized stage of regeneration. Preferably, the second regeneration zone comprises a vertically elongated vessel having a length and diameter suitably adjusted for providing gas and solids residence times and solids fluidization according to the parameters of the process. In order to prevent gross back-mixing of generally downward moving particles in the second regeneration stage, the vessel employed should be equipped with some sort of means for impeding back-mixing such as barriers, baffles, solids or gas dispersing means, redistribution means, or the like. For example, perforated plates, bars, screens, packing material, or other suitable internals may be used to impede back-mixing.

The catalyst entrainment-regeneration gas introduced, in addition to the desired amount of molecular oxygen, may include such relatively inert gases as nitrogen, steam, carbon monoxide, carbon dioxide, and the like. The composition of the entraining gases will, of course, vary along the gas flow path through the regeneration zone, as the gases pass from the upstream end to the downstream end of the riser regenerator. The amount of entraining gas and its pressure and superficial velocity in the riser are maintained at levels such that the particles present in the riser are entrained upward through the riser.

A solids residence time in the relatively low density phase zone of the riser-regenerator of about 3 to about 6 seconds and a gas residence time of about 2 to about 4 seconds is generally suitable. Preferably, when the entraining gas is recovered from the riser-regenerator, it has a sufficiently high fuel value to have utility as a fuel gas. The utility of the effluent gas from the riser-regenerator as a fuel gas will depend primarily on the carbon monoxide content of the gas. This may vary according to the oxygen and steam partial pressures, the total pressure, the gas and solids residence times and the exact temperature maintained in the riser-regenerator. The amount of molecular oxygen (free oxygen) introduced into the first stage regeneration zone is preferably controlled to provide the desired degree of coke burn off in the entrained bed regenerator, whether all the oxygen is introduced at the downstream end of the regenerator or some is introduced further along the entraining gas path. The entraining gas exiting the first regeneration zone should generally have an oxygen concentration of not more than about 0.5 volume percent. Preferably, the effluent gas contains not more than about 0.1 volume percent molecular oxygen. Where it is desired to operate the riser reactor to obtain a high fuel value flue gas, the first and second reactors suitably have separate flue systems.

After the partially regenerated particulates have been removed from the riser reactor and separated from the entraining gas stream, the particles are subject to a second stage of regeneration in a fluidized bed, wherein the particles moved generally downward in a countercurrent flow relative to a fluidizing stream of gases. In carrying out the second stage of regeneration, particles are passed into the upper end of a generally vertical extending regeneration zone, in which the particles are fluidized by an upwardly flowing stream of gases. Coke-free, regenerated particles are withdrawn from the lower end of the regeneration zone and/or recirculated to the first reactor.

The invention also relates to an apparatus for the removal of carbonaceous materials from particles containing such materials. In this respect reference is made to FIG. 1 which represents an apparatus according to the invention, comprising a first, riser-type reactor (1) comprising a normally vertical, elongated reactor provided with solids inlet means (2) and gas inlet means (3) at the lower end of the reactor; means for separating solids and gas (4) with the inlet (5) fluidly connected with the upper end of the first reactor, and having a gas (6) and a solids outlet (7); a second, fluidized bed reactor (8), comprising a normally vertical reactor connected with the solids outlet (7) of the gas/solids separation means and provided with gas inlet means (9) at the bottom of the reactor and with solid outlet means (10); and means (11) for connecting the first and the second reactor to allow for the recirculation of solids from the second reactor to the first reactor.

In a preferred embodiment, the lower end of the riser reactor has a larger diameter than the upper part of the reactor, as is shown in FIG. 1. Further details on this feature have been described above. Also conical reactors may be used.

In another preferred embodiment, one or more additional gas inlet means (12) are present above the lower end of the reactor. Preferably the solids outlet means of the gas/solids separation means are connected with the upper end of the second reactor. Suitably one or more cyclones may be used. The solids outlet means of the second reactor are preferably present at the lower end of the reactor. The second, fluidized bed-type reactor is preferably provided with internals (13) making it possible to create a staged fluidized bed. Plates, gauges, trays, and such may be used. The solids recirculation means is preferably provided with a valve, making adjustment of the recirculation ratio possible. The second reactor may be provided with a separated gas outlet at the upper part of the reactor, or the gas outlet may be combined with the gas outlet of the gas/solids separation means as for instance has been described in European patent application No. 0206399. The second reactor may be provided with heat exchanging means in the lower part of the reactor. Preferably, a cooling heat exchange device is provided at the bottom of the reactor as for instance has been described in European patent application No. 340852.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

What is claimed is:

1. A process for the removal of carbonaceous materials from particles containing such materials using two reactors each with a distinguishable upper and lower part, the process comprising:

a. introducing said particles into said lower part of a first, riser-type reactor along with an oxygen-containing gas;

b. reacting said particles with said oxygen-containing gas such that a resulting flue gas is formed;

c. reacting said particles with said oxygen-containing gas in said first reactor under entrainment conditions with a relatively high density phase in said lower part and a relatively low density phase in said upper part at a temperature suitable to burn said carbonaceous materials off of said particles at such a rate that said flue gas at the top of said first riser reactor does not contain any substantial amount of oxygen;

d. separating said flue gas and said reacted particles at the top of said first riser reactor;

e. introducing said reacted particles into said upper part of a second, fluidized bed-type reactor while also introducing an oxygen-containing gas into said lower part of said second reactor;

f. operating said second reactor under fluidized bed conditions at a temperature suitable to burn off said carbonaceous materials and produce a flue gas and processed particles and further adjusting the amount of oxygen-containing gas being utilized in such a way that said flue gas at the top of said second reactor is substantially free of oxygen; and g. removing said processed particles from the lower part of said second reactor, and recirculating a part of said processed particles to said lower part of said first riser reactor.

2. The process of claim 1 wherein said oxygen-containing gas is present in a substoichiometric amount.

3. The process of claim 2, wherein said substoichiometric amount of oxygen introduced in said first riser-type reactor is sufficient to burn off about 20 to about 70% of said carbonaceous materials.

4. The process of claim 3, wherein the temperature in said first riser-type reactor is from about 525° C. to about 725° C., and the temperature of said second reactor is from about 625° C. to about 950° C.

5. The process of claim 2, wherein the ratio of the densities of said relatively high density phase and said relatively low density phase is from about 5 to about 50.

6. The process of claim 5, wherein the ratio of the densities of said relatively high density phase and said relatively low density phase is from about 10 to about 30.

7. The process of claim 2, wherein said carbonaceous materials containing said particles are spent FCC catalyst particles.

8. The process of claim 7, wherein the amount of carbon on said FCC catalyst particles is from about 0.5 t 4% by weight.

9. The process of claim 2, wherein the pressure in said first riser-type reactor and said second reactor is from about 1 bar to about 10 bar.

10. The process of claim 9, wherein the pressure drop over said first riser-type reactor is from about 0.1 bar to about 2 bar and the pressure drop over said second reactor is from about 1 bar to about 5 bar.

11. The process of claim 2, wherein said second reactor is a staged fluidized bed reactor.

12. The process of claim 2, wherein the ratio of the amount of said particles which are removed from said second reactor and the amount of particles which are recirculated to said first riser-type reactor is from about 0.1 to about 10.

13. A process for the removal of carbonaceous materials from particles containing such materials using two reactors, the process comprising:

a. introducing said particles into the lower part of a first, riser-type reactor along with a substoichiometric amount of oxygen sufficient to burn off from about 20% to about 70% of said carbonaceous materials thereby resulting in the production of a flue gas and reacted particles;

b. reacting said particles with said oxygen-containing gas such that a flue gas entraining reacted particles is formed;

c. reacting said particles with said oxygen in said first reactor under entrainment conditions with a relatively high density phase in said lower part and a relatively low density phase in said upper part with the ratio of the densities of the relatively high density phase and the relatively low density phase being from about 5 to about 50 and at a temperature from about 525° C. to about 725° C. which is suitable to burn said carbonaceous materials off of said particles at such a rate that said flue gas at the top of said first reactor does not contain any substantial amount of oxygen;

d. separating said reacted particles and said flue gas at the top of said first reactor;

e. introducing said reacted particles into the upper part of a second fluidized bed-type reactor while also introducing an oxygen-containing gas into the lower part of said second reactor;

f. operating said second reactor under fluidized bed conditions at a temperature from about 625° C. to about 950° C. which is suitable to burn off said carbonaceous materials and produce a flue gas and processed particles and further adjusting the amount of oxygen-containing gas being utilized in such a way that said flue gas at the top of said second reactor is substantially free of oxygen; and g. removing said processed particles from the lower part of said second reactor, and recirculating a part of said processed particles to said lower part of said first reactor wherein the ratio of the amount of particles which are removed from said second reactor and the amount of particles which are recirculated to said first reactor is from about 0.2 to about 5.

* * * * *